US008497776B2

(12) United States Patent
Stern

(10) Patent No.: US 8,497,776 B2
(45) Date of Patent: Jul. 30, 2013

(54) RADIO FREQUENCY IDENTIFICATION SYSTEM AND METHOD USED TO PERFORM ELECTRONIC ARTICLE SURVEILLANCE

(75) Inventor: Miklos Stern, Woodmere, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 269 days.

(21) Appl. No.: 12/981,059

(22) Filed: Dec. 29, 2010

(65) Prior Publication Data

US 2012/0169500 A1 Jul. 5, 2012

(51) Int. Cl.
*G08B 21/00* (2006.01)

(52) U.S. Cl.
USPC ..... 340/572.7; 340/572.1; 340/10.1; 235/385; 705/23

(58) Field of Classification Search
USPC ..... 340/572.1, 10.1; 235/385; 705/23
See application file for complete search history.

(56) References Cited

U.S. PATENT DOCUMENTS 3,577,136 A * 5/1971 Wolf ..... 340/572.1
3,755,803 A * 8/1973 Cole et al. ..... 340/572.1
4,994,939 A * 2/1991 Rubertus et al. ..... 361/831
2009/0002165 A1 1/2009 Tuttle
2009/0045955 A1 2/2009 Ulrich

OTHER PUBLICATIONS

PCT International Search Report Dated March 16, 2012 for Counterpart Application PCT/US2011/066714.

* cited by examiner

*Primary Examiner* — Benjamin C Lee
*Assistant Examiner* — Mark Rushing
(74) *Attorney, Agent, or Firm* — Terri H. Smith; Kenneth A. Haas

(57) ABSTRACT

A radio frequency identification (RFID) system used to perform electronic article surveillance comprises a RFID tag and a RFID reader. The RFID tag is affixed to an object, and the RFID reader, having a plurality of antennas, is in radio frequency (RF) communication with the RFID tag. The plurality of antennas are arranged to have a spatial relationship with one another to monitor and communicate with the RFID tag such that a likelihood of a security breach of the RFID tag is determined. Determining the likelihood of the security breach is based, at least in part, on a signal strength of a read of the RFID tag at each antenna relative to the plurality of antennas.

15 Claims, 6 Drawing Sheets

RADIO FREQUENCY IDENTIFICATION SYSTEM AND METHOD USED TO PERFORM ELECTRONIC ARTICLE SURVEILLANCE

FIELD OF THE INVENTION

The present invention relates generally to radio frequency identification (RFID) systems and methods. More particularly, the present invention relates to an RFID system and method used to perform electronic article surveillance.

BACKGROUND OF THE INVENTION

Conventionally, an electronic article surveillance (EAS) system is utilized to provide premises security, such as, for example, in retail environments, warehouse environments, and the like. In these cases, EAS systems are usually located at physical egress/ingress points to monitor for security breaches. In the retail context, these systems include special tags that are activated and affixed to articles for which theft detection is desired, along with tag detectors having transmit and receive antennas that typically are positioned at exits of a retail store. Conventional EAS systems have been successful at deterring and detecting article theft, however, current systems suffer from some significant drawbacks, such as, limited range in detecting an EAS tag, limited or no information regarding the item affixed to the EAS tag, and binary results of whether to sound an alarm.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
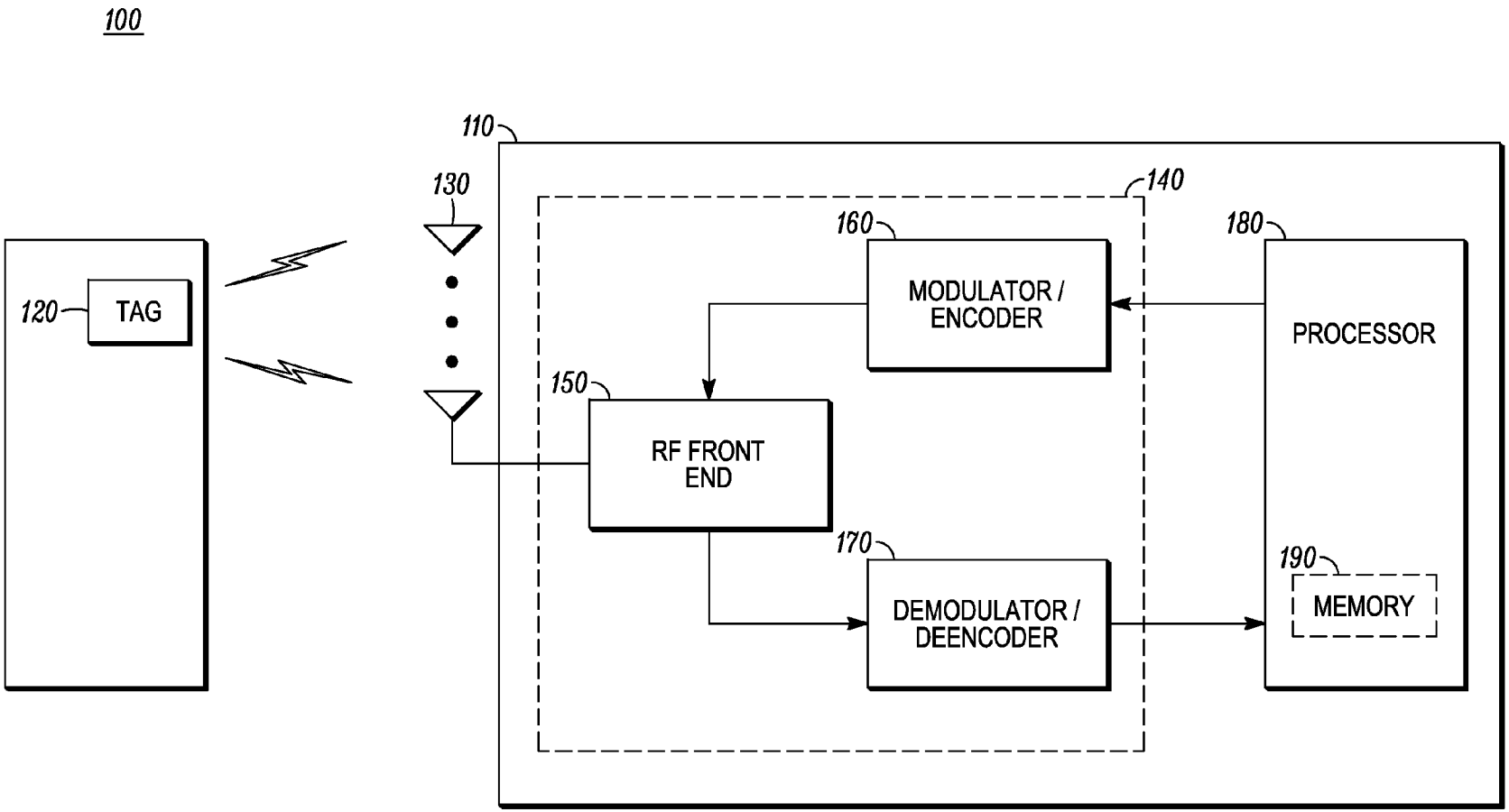
FIG. 1 is an exemplary block diagram of a RFID system comprising a RFID reader and a RFID tag.

A RFID system in accordance with the present invention performs electronic article surveillance or theft detection, while providing more accurate and detailed information, resulting in more intelligent and nuanced decisions. The RFID system of the present invention provides an indication of a security breach, or a likelihood of a security breach, while minimizing false alarms. In particular, tracking RFID tags in an environment, such as on the retail floor, particularly near the entrance/exit of a physical infrastructure where the RFID system may be deployed, enables a more accurate determination whether items are leaving or entering the store, and just as importantly, which items. Moreover, the present invention allows time for the RFID reader and/or back-end system to search a database, or query the RFID tag, to obtain additional information about the RFID tag (e.g. whether the item associated with the RFID tag was purchased), and, if necessary, execute an algorithm, that uses weighted and/or un-weighted information about the RFID tag, and possibly the surrounding environment, to determine whether the particular tag is allowed to leave the store prior to the RFID system taking an action, such as sounding an alarm, sending a real-time alert to store personnel, recording the incident in a database, or the like.

Based on the results of the algorithm, the RFID system of the present invention is able to assess the likelihood of a security breach, and act according to the level or category of risk. For example, the RFID reader and/or back-end system may sound an alarm (audible, visual, or silent) and notify store personnel of the type and cost of the unpaid item; provide a real-time alert (via text message, instant mail, email, or the like), which may include the type and cost of the unpaid item, to the store personnel about a potential impending security breach of an item as the item approaches the vicinity of the entrance/exit, if necessary; or simply record the incident in a database without notifying the store personnel. Alternatively, or additionally, the RFID system of the present invention may be configured to determine a phase of the read of the RFID tag at each antenna relative to the plurality of antennas, or implement a distributed antenna or reader system, that tracks the movement of an RFID tag as it approaches the entrance/exit to provide advanced warning to store personnel. Armed with this advanced warning, store personnel may address the situation in a more amicable fashion and approach the person in a more discreet manner, rather than merely sounding an alarm, or confronting customers who have already left the store. For example, store personnel may simply approach the entrance/exit discouraging the person from leaving the premises with the unpaid merchandise. Alternatively, store personnel may gently request that the customer look through his/her merchandise to ascertain that there is nothing that was not paid for. Let us turn to the figures to describe the present invention in greater detail.

Referring to FIG. 1, an exemplary RFID system 100 is illustrated. The RFID system 100 may be deployed in any type of physical infrastructure in which electronic article surveillance or theft detection is desired, such as the entrance/exit locations of a warehouse, a distribution center, a retail building, an office building, a library, or the like. The RFID system 100 comprises a RFID reader 110 and a RFID tag 120. The RFID reader 110 is in RF communication with the RFID tag 120.

FIG. 1 also illustrates an exemplary block diagram of the RFID reader 110. Specifically, the RFID reader 110 comprises a plurality of antennas 130, a transceiver 140, and a processor 180 coupled to the transceiver 140. It should be appreciated that FIG. 1 depicts the RFID reader 110 in an oversimplified manner and a practical embodiment of the RFID reader 110 may include additional components and suitably configured processing logic to support known or conventional operating features that are not described in detail herein. In general, the RFID reader 110 includes software, hardware, and/or firmware, or any combination thereof, for performing functions associated with the RFID reader 110, such as communicating with RFID tags 120 through its plurality of antennas 130. Specifically, the RFID reader 110 is capable of transmitting an interrogation signal, and receiving a tag response signal that can be decoded to derive tag data.

The RFID reader 110 may operate in one or more of the frequency bands allotted for this type of RF communication, for example, but not limited to, frequency bands of 13.5 MHz, 902-928 MHz and/or 2400-2483.5 MHz have been defined for certain RFID applications in the United States by the Federal Communication Commission (FCC). Different frequency bands, other than those listed above, may be used in the United States and in other countries for RFID applications, for example, in Europe, 865-868 MHz as well as other frequencies, as known by those skilled in the art of RFID. A variety of mechanisms may be used to initiate an interrogation signal by the RFID reader 110, which are readily known to a person of ordinary skill in the art, and will not be described in detail herein.

The RFID reader 110 may be coupled to one or to a plurality of antennas 130 for RF communication with the RFID tag 120. It is important to note that an antenna 130 may be physically located within the RFID reader 110, such as in the same housing, or may be physically separate and coupled to the RFID reader 110 (e.g. via a wired or wireless connection). The present invention contemplates any type of antenna 130 known to those of ordinary skill in the art, such as, but not limited to, vertical, dipole, loop, Yagi-Uda, slot, or patch antenna types. The antennas 130 are disposed in the physical infrastructure in spatial relationship with one another such that the RFID reader 110 may infer a location of the RFID tag 120 based on the various readings of the RFID tag 120 by the plurality of antennas 130.

The configuration of the transceiver 140 shown in FIG. 1 is provided for purposes of illustration only, and is not intended to be limiting. The transceiver 140 may be configured in numerous ways to modulate, transmit, receive, and demodulate RFID communication signals, as is readily known to those of ordinary skill in the art. The transceiver 140 includes circuitry and other electronics to interface between wireless over-the-air communications and digital communications with the processor 180. Specifically, the transceiver 140 typically comprises a RF front-end 150, a modulator/encoder 160, and a demodulator/decoder 170, which may include software, hardware, and/or firmware, or any combination thereof, for performing associated functions that are readily known to persons of ordinary skill in the art, and will not be described in detail herein.

The processor 180 can be any microprocessor, application specific integrated circuit (ASIC), field programmable gate array (FPGA), digital signal processor (DSP), any suitable programmable logic device, discrete gate or transistor logic, discrete hardware components, or combinations thereof that has the computing power capable of managing the transceiver 140 and the plurality of antennas 130 of the RFID reader 110. Further, the processor 180 may include memory 190, which may comprise volatile memory (e.g. random access memory (RAM), such as dynamic random access memory (DRAM), static random access memory (SRAM), synchronized dynamic random access memory (SDRAM), etc.), nonvolatile memory (e.g. read only memory (ROM), hard drive, tape, compact disc read only memory (CD-ROM), etc.), and combinations thereof. The memory 190 may be a part of or separate from the processor 180. The software stored in the memory 190 may include one or more applications, each of which includes an ordered listing of executable instructions for implementing logical functions. The processor 180, with its associated memory 190, generally represents the hardware, software, firmware, processing logic, and/or other components of the RFID reader 110 that enables communication between the RFID reader 110 and the RFID tags 120, other RFID readers, and other network components to which the RFID reader 110 communicates. The processor 180 is configured to execute software instructions and algorithms stored within the memory 190, to communicate data to and from the memory 190, and to generally control the operations of the RFID reader 110 pursuant to the software instructions. It should be noted that the processor 180 may be located within the RFID reader 110, or may be located remote from the RFID reader 110.

The RFID tag 120 is configured to backscatter one or more tag response signals in response to receiving an interrogation signal from the RFID reader 110. If within the coverage area of the RFID tag 120, the RFID reader 110 is configured to receive one or more response signals from the RFID tag 120 via its respective antennas 130 (e.g. either one antenna at a time, or simultaneously, for example, like in the case of a phased-array antenna configuration), and to obtain associated data related to the RFID tag 120 from the one or more response signals. It should be noted that the RFID tag 120 and the RFID reader 110 may be capable of communicating according to any suitable communication protocol, including Class 0, Class 1, EPC Gen 2, other binary traversal protocols and slotted ALOHA protocols, any other protocols mentioned elsewhere herein, future communication protocols, etc.

Figure 2:
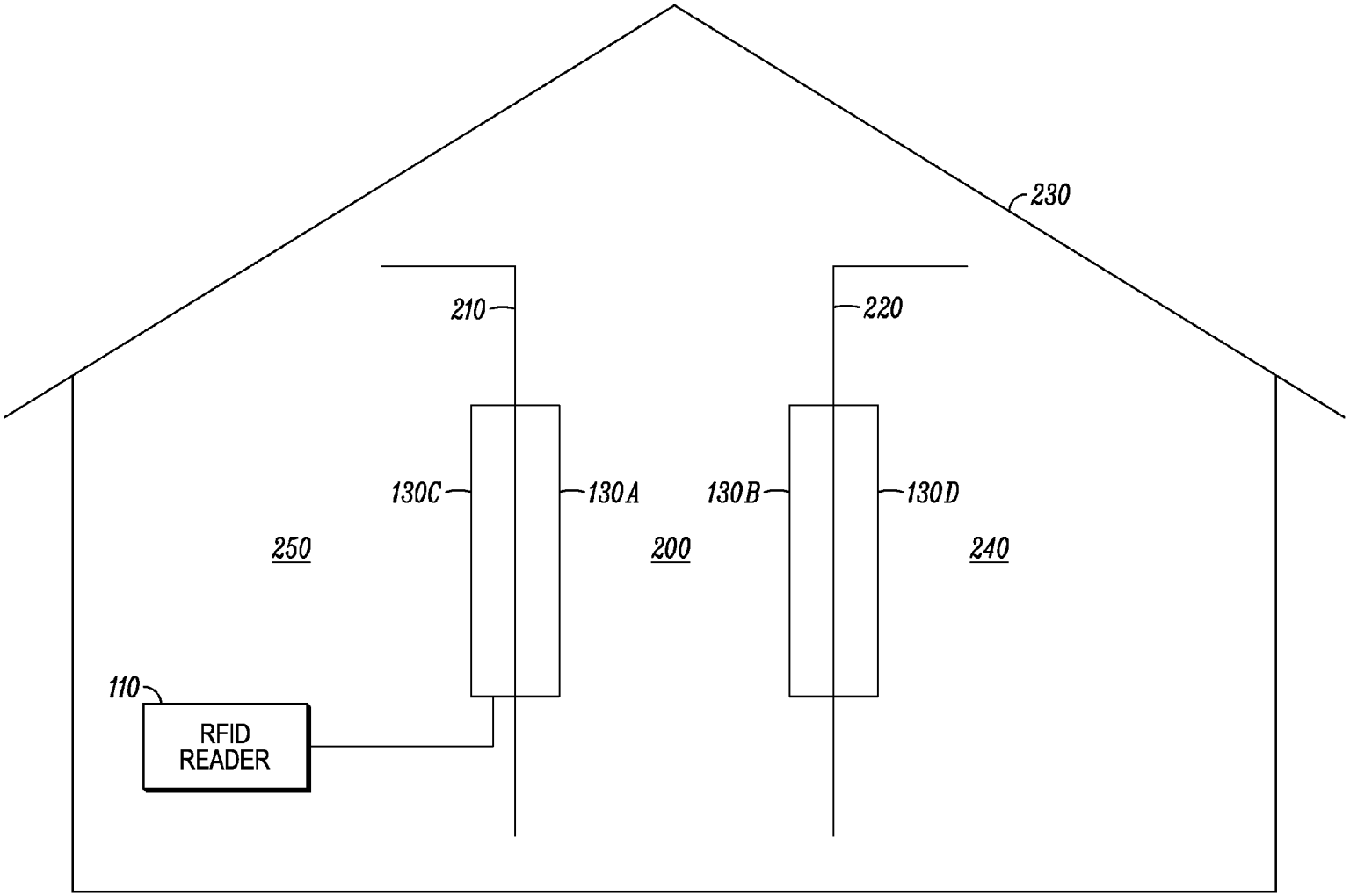
FIG. 2 is a diagram illustrating an exemplary arrangement of a plurality of antennas coupled to the reader having a spatial relationship with one anther and disposed on a single gate used for ingress/egress of the physical infrastructure.

Let us turn our attention to some examples of how the RFID system 100 may be deployed in a physical infrastructure in accordance with the present invention. In one embodiment, the RFID system 100 comprises a RFID tag, and a RFID reader 110 having a plurality of antennas 130. The plurality of antennas 130 are arranged to have a spatial relationship with one another to monitor and communicate with the RFID tag 120 such that a likelihood of a security breach of the RFID tag can be determined. In this embodiment, a security breach, or the likelihood of a security breach, is based, at least in part, on a signal strength of the read of the RFID tag at each antenna relative to the plurality of antennas 130. For example, as illustrated in FIG. 2, four antennas 130*a*, 130*b*, 130*c* and 130*d* are coupled to the RFID reader 110 and disposed to a gate 200, which includes a first post 210 and a second post 220. Here, a person and/or object are required to pass through the gate 200 for ingress/egress of the physical infrastructure 230. The antennas 130 are arranged such that antennas 130*a*, 130*b* are each disposed on the posts 210,220, respectively, facing one another toward an inside of the gate 200. The antennas 130*c*, 130*d* are each disposed on opposite sides of the posts 210, 220, respectively, from the antennas 130*a*, 130*b*. Specifically, the antennas 130*a*, 130*b* may be referred to as inward facing with respect to the gate 200 with the antennas 130*c*, 130*d* outward facing with respect to the gate 200. In various exemplary embodiments, the RFID system 100 utilizes this spatial relationship and directionality of the antennas 130 in determining a security breach, or the likelihood thereof, based on various readings of RFID tags by the plurality of antennas 130.

As noted above, the antennas 130*a*, 130*b*, 130*c*, and 130*d* monitor their surroundings for RFID tags 120. RFID tags 120 may move around in the environment, but still not pose a risk of a security breach. Since the antennas 130*a*, 130*b*, 130*c*, are 130*d* are directional in nature, there may be a significant difference in signal strength amongst the antennas 130 from RFID tags 120 located inside and outside the gate 200. For example, if a RFID tag 120 is located outside the gate 200 towards the right in area 240, then the antenna 130*d* is likely to have the strongest signal, while antenna 130*b* is likely to have the weakest signal. It is also expected that antenna 130*a* will have a strong signal, while antenna 130*c* will have a weak signal. In this scenario, the relative signal strength of the plurality of antennas 130 would indicate a low likelihood of a security breach of the RFID tag 120. In the same regard, if the RFID tag 120 is located outside the gate 200 towards the left in area 350 with the antennas 130*c* and 130*b* having stronger signals than antennas 130*d* and 1304*a*. Again, the relative signal strength of the plurality of antennas 130 would indicate a low likelihood of a security breach of the RFID tag 120. If, however, the RFID tag 120 is located inside the gate 200, then antennas 130*a*, 130*b* are likely to both have stronger signal strength readings, while antennas 130*c*, 130*d* are likely to have weaker signal strength readings. In this situation, the relative signal strength of the plurality of antennas 130 would indicate a high likelihood of a possible security breach of the RFID tag 120, and the RFID system 100 would need to gather additional information about the RFID tag 120 and surrounding environment to determine the appropriate action to take, as discussed in further detail below.

Figure 3:
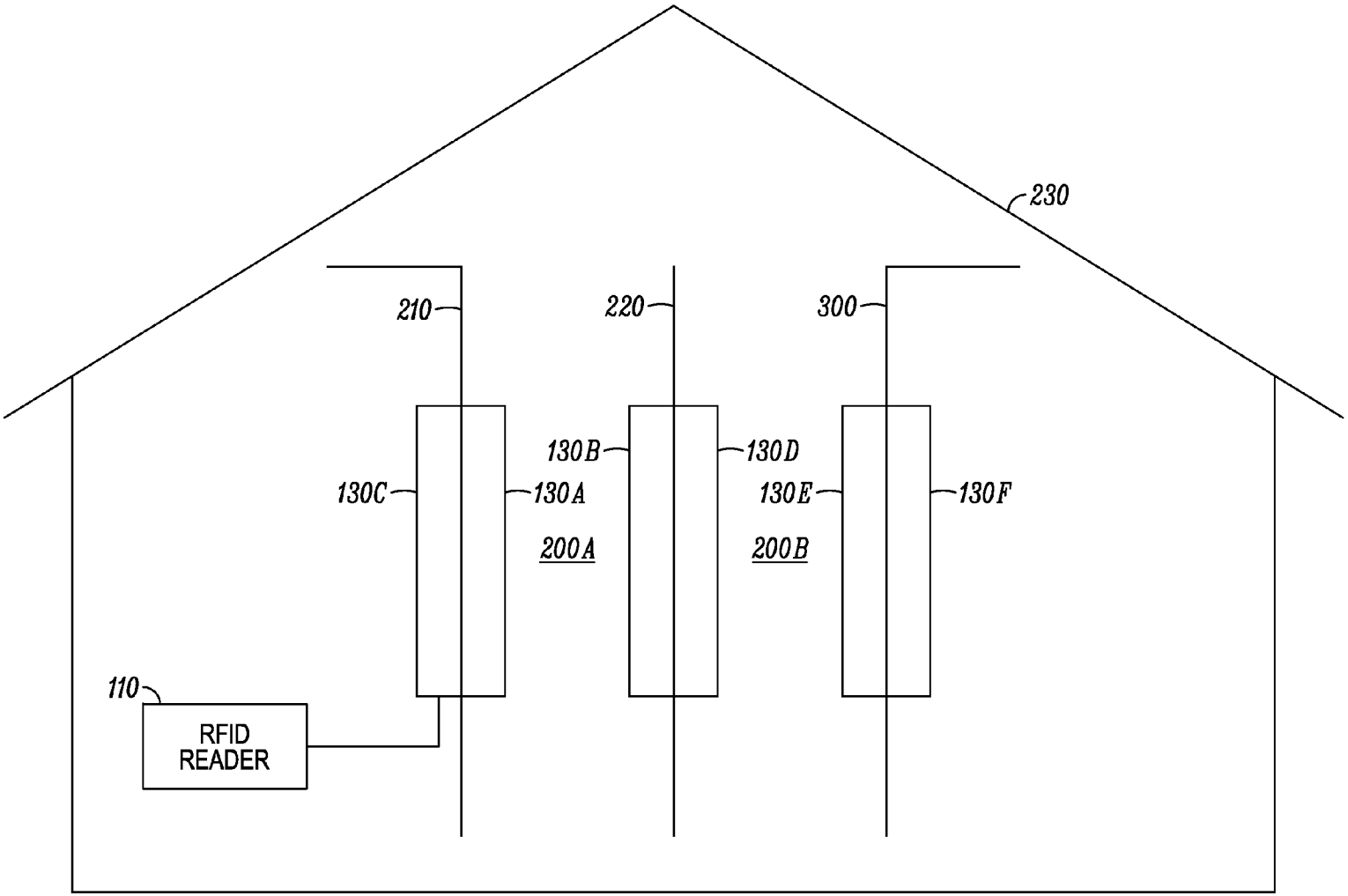
FIG. 3 is a diagram illustrating an arrangement of a plurality of antennas coupled to the reader having a spatial relationship with one anther and disposed on a plurality of gates used for ingress/egress of the physical infrastructure.

It will be appreciated by a person of ordinary skill in the art that the number of antennas 130 coupled to a RFID reader 110 and the number of RFID readers 110 in the RFID system 100 may vary depending on the system design and requirements. Moreover, the number of ingress/egress locations 200 of the physical infrastructure 230 will vary as well. For example, FIG. 3 illustrates the RFID system 100 extending across two gates 200*a* and 200*b*. In this example, the RFID reader 110 comprises six antennas 130*a*, 130*b*, 130*c*, 130*d*, 130*e*, and 130*f* which are each communicatively coupled therebetween and disposed on three posts 210, 220, 300. The posts 210, 220 form the gate 200*a*, and the posts 220, 300 form the gate 200*b*, i.e. the post 220 is common to both the gates 200*a*, 200*b*. The antennas 130*a*, 130*b* are inward facing with respect to the gate 200*a* and the antennas 130*c*, 130*d* are outward facing with respect to the gate 200*a*. However, with respect to the gate 200*b*, the antennas 130*d*, 130*e* are inward facing whereas the antennas 130*b*, 130*f* are outward facing.

Figure 4:
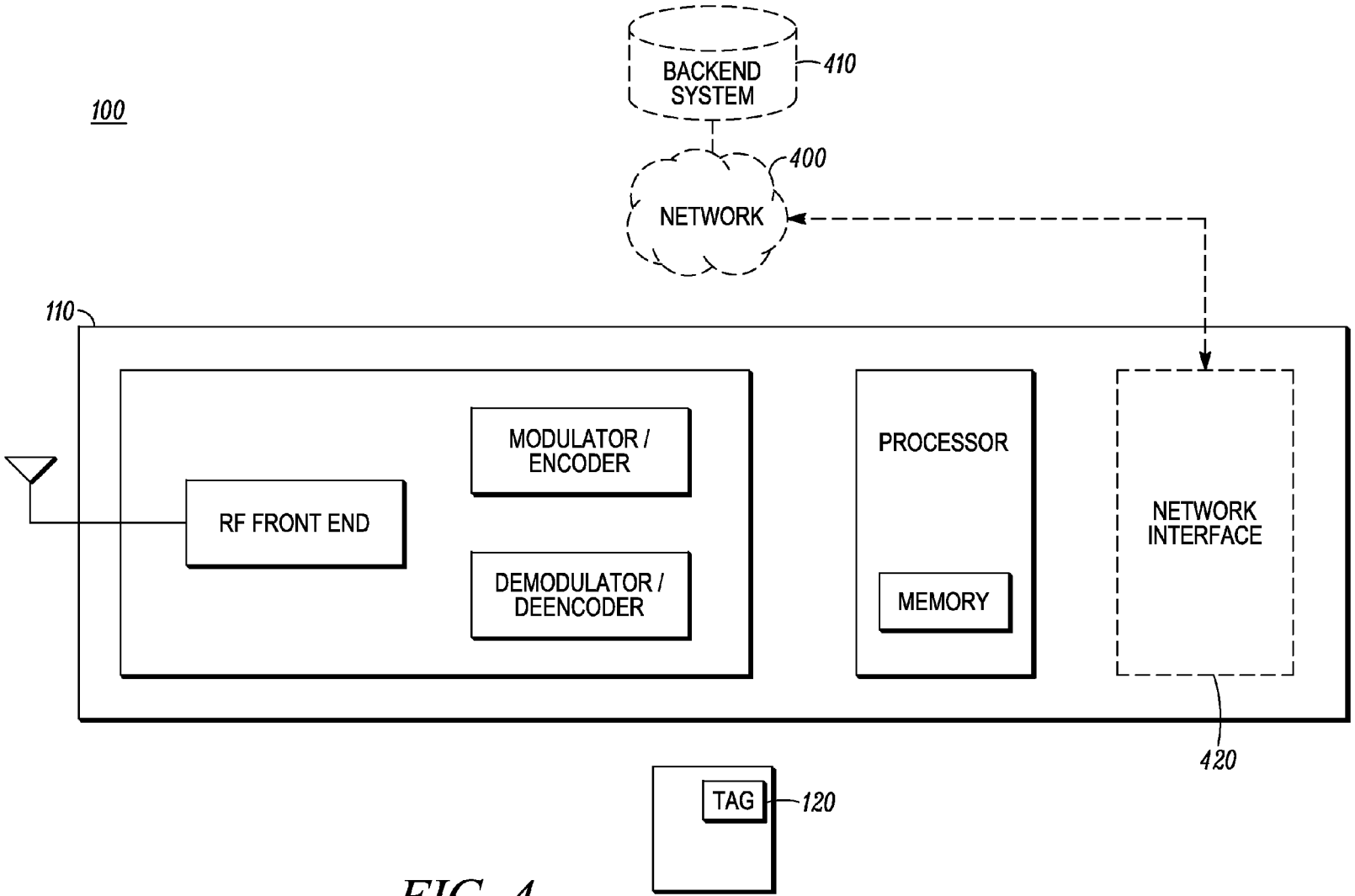
FIG. 4 is an exemplary block diagram of the RFID system of FIG. 1 comprising an optional network and an optional back-end system.

Optionally, the RFID system 100 may also comprise a network 400 and a back-end system 410 (e.g. a server, a computer, or the like) as shown in FIG. 4. If the network 400 and the back-end system 410 are present in the RFID system 100, the RFID reader 110 will further comprise a network interface 420 that is coupled to the processor 180, and the RFID reader 110 is communicatively coupled, via the network 400, to the back-end system 410. The network interface 420 may be used to enable the RFID reader 110 to communicate on the network 400. The network interface 420 may include, for example, an Ethernet card (e.g. 10BaseT, Fast Ethernet, Gigabit Ethernet) or a wireless local area network (WLAN) card (e.g. 802.11a/b/g). The network interface 420 may include address, control, and/or data connections to enable appropriate communications on the network 400. It should be noted that in some embodiments, the network interface 420 may be used to receive the interrogation signal, for example, from a remote computer system or server, such as the back-end system 410, or the like. Thus, the network interface 420 may be used to enable the RFID reader 110 to communicate on the network 400 to the back-end system 410: if the processor 180 is located remotely from the RFID reader 110, the network interface 420 may be used to communicate between the transceiver 140 and the back-end system 410, which could include the processor; if the processor 180 is located within the RFID reader 110, the network interface 420 may be used to communicate between the processor 180 and the back-end system 410.

Figure 5:
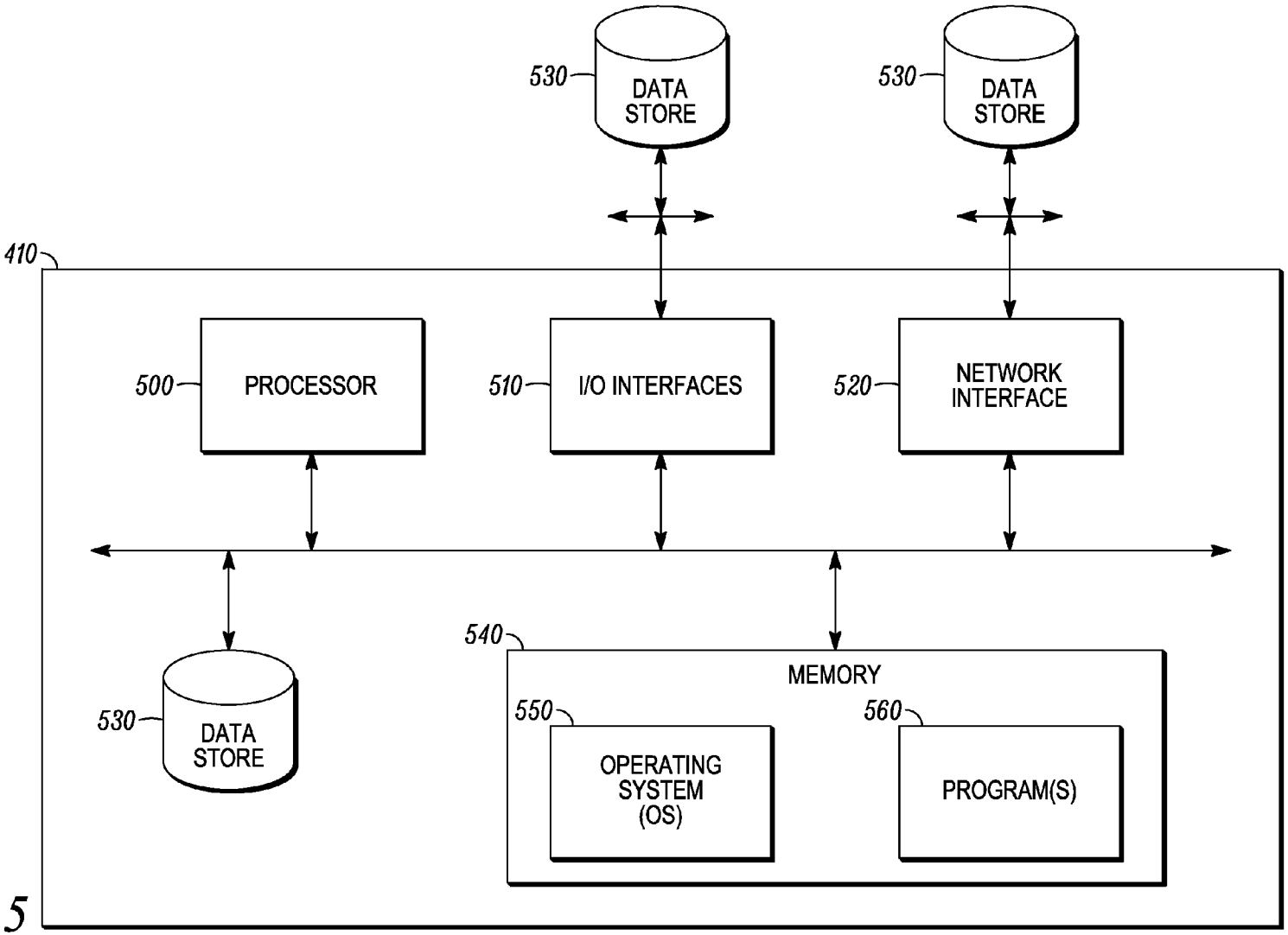
FIG. 5 is an exemplary block diagram of the optional back-end system of FIG. 4.

Referring to FIG. 5, an exemplary block diagram of the optional back-end system 410 is illustrated for use in the RFID system. The back-end system 410 may be a digital computer that, in terms of hardware architecture, generally includes a processor 500, input/output (I/O) interfaces 510, a network interface 520, a data store 530, and memory 540. The components (500, 510, 520, 530, and 540) are communicatively coupled via a local interface 570. The local interface 570 may be, for example but not limited to, one or more buses or other wired or wireless connections, as is known in the art. The local interface 570 may have additional elements, which are omitted for simplicity, such as controllers, buffers (caches), drivers, repeaters, and receivers, among many others, to enable communications. Further, the local interface 570 may include address, control, and/or data connections to enable appropriate communications among the aforementioned components. It should be appreciated that FIG. 5 depicts the back-end system 410 in an oversimplified manner, and a practical embodiment may include additional components and suitably configured processing logic to support known or conventional operating features that are not described in detail herein.

The processor 500, like the processor 180 described above in the RFID reader, can be any microprocessor, ASIC, FPGA, DSP, any suitable programmable logic device, discrete gate or transistor logic, discrete hardware components, or combinations thereof that has the computing power capable of managing and controlling the back-end system. For sake of brevity, the processor 500 may comprise similar components as described above and as known in the art.

The I/O interfaces 510 may be used to receive user input from and/or for providing system output to one or more devices or components. I/O interfaces 510 may include, for example, a serial port, a parallel port, a small computer system interface (SCSI), an infrared (IR) interface, a radio frequency (RF) interface, a Bluetooth® interface, and/or a universal serial bus (USB) interface.

The network interface 520 may be used to enable the back-end system 410 to communicate on a network, such as the network 400. The network interface 520 may include, for example, an Ethernet card (e.g., 10BaseT, Fast Ethernet, Gigabit Ethernet) or a wireless local area network (WLAN) card (e.g., 802.11a/b/g/n). The network interfaces 520 may include address, control, and/or data connections to enable appropriate communications on the network. In conjunction with the RFID system 100, the network interface 520 may be used to communicate with the RFID reader 110.

The data store 530 may be used to store data in a digital format. The data store 530 may include volatile memory, non-volatile memory, or combinations thereof. Moreover, the data store 530 may incorporate electronic, magnetic, optical, and/or other types of storage media. In one example, the data store 530 may be located internal to the back-end system 410, such as, for example, an internal hard drive, connected to the local interface 570. Additionally, in another embodiment, the data store 530 may be located external to the back-end system 410, such as, for example, an external hard drive connected to the I/O interfaces 510 (e.g. SCSI or USB connection). Finally, in a third embodiment, the data store 530 may be located external and coupled to the back-end system 410 through a network, such as, for example, a network attached file server. In various exemplary embodiments, the back-end system 410 may use the data store 530 to store RF profiles of the environment as well as a database of information associated with RFID tags 120 (e.g. type of item, price of item, etc.). For example, the back-end system 410 may be able to access a system database in the data store 530 in order to determine the nature and cost of an item associated with the RFID tag 120 passing through the gate 200, thus enabling the RFID system 100 to make an intelligent decision about creating an alarm condition.

The memory 540 may include volatile memory, nonvolatile memory, or combinations thereof. Moreover, the memory 540 may incorporate electronic, magnetic, optical, and/or other types of storage media. Note that the memory 540 may have a distributed architecture, where various components are situated remotely from one another, but can be accessed by the processor 500. The software in memory 540 may include one or more software programs, each of which includes an ordered listing of executable instructions for implementing logical functions. In the example of FIG. 5, the software in the memory 540 includes a suitable operating system (O/S) 550 and programs 560. The operating system 550 essentially controls the execution of other computer programs, and provides scheduling, input-output control, file and data management, memory management, and communication control and related services. The programs 560 can be any off-the-shelf or customize application to be executed by the RFID system 100, such as, but not limited to, various RFID applications, inventory management applications, point-of-sale (POS) applications, article surveillance applications, theft detection applications, or the like.

Optionally, the RFID system 100 may further comprise an infrared sensor and/or a motion detection sensor that is coupled to the RFID reader 110. Information gathered from the sensor (e.g. whether an infrared link between an infrared transmitter and receiver was broken, or whether motion is detected in the environment surrounding the plurality of antennas 130 (i.e. inside the gate 200)) may be used in the algorithm to further enhance the determination of the likelihood of a security breach. It is important to note that the motion sensing and/or infrared links are not an absolute indication of a security breach, since another person may be passing through the entrance/exit 200 while a RFID tag 120 is being carried nearby by someone else. Rather, the motion sensing and infrared links are used to further enhance the determination of the likelihood of a security breach, and reducing false alarms, since if no one is passing through the gate 200, then it is highly unlikely that a RFID tag 120 affixed to an item that has not been purchased is passing through the gate 200 (i.e. a security breach), regardless of the signal strength of the RFID tag 120 being detected.

Figure 6:
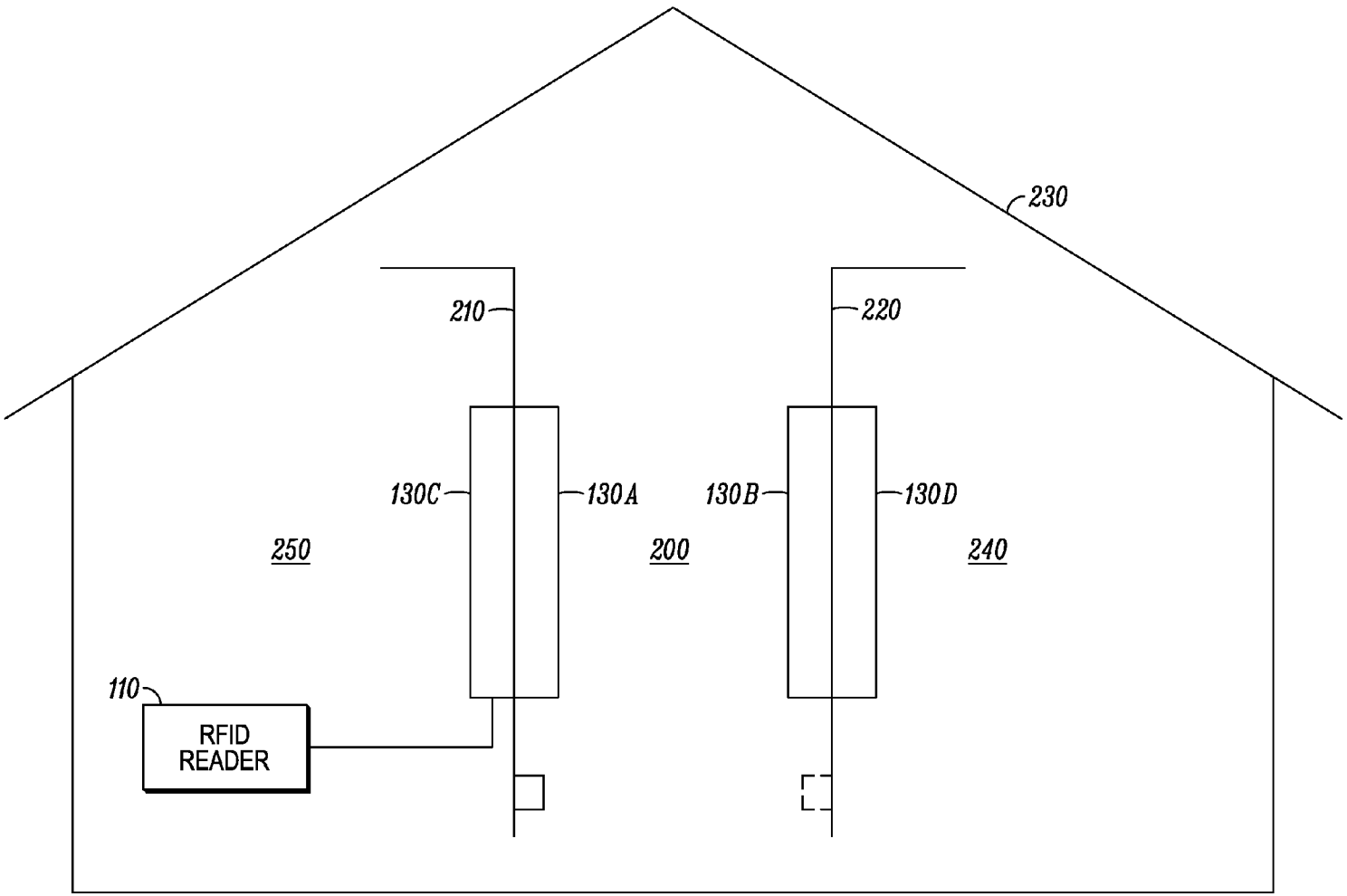
FIG. 6 is a diagram illustrating an exemplary arrangement of a plurality of antennas of FIG. 2 comprising an optional sensor.

The infrared sensor and/or the motion detection sensor 600 may be a stand alone component, or integrated within the antennas 130*a*, 130*b*, i.e. part of a same housing. Also, the infrared sensor and/or the motion detection sensor 600 may be placed before, after, besides, over, or under at least one of the plurality of antennas 130*a*, 130*b*. For example, referring back to FIG. 6, a directional infrared sensor and/or the motion detection sensor 600 may be disposed in the gate 200 (inward facing with respect to the gate) to provide an indication of an object and/or person passing through the gate 200 (e.g. if an interruption is detected in an infrared link being emitted from the infrared sensor 600, or if motion is detected in the surrounding environment). In one embodiment, the infrared sensor and/or the motion detection sensor 600 may be separated into two components such that a transmitter is disposed on post 210, and a receiver is disposed, opposite the transmitter, on post 220. In another embodiment, the infrared sensor and/or the motion detection sensor 600 may be simplified by packaging the transmitter and receiver together and disposing it on post 210, and placing a reflector, opposite the transmitter and receiver, on post 220. In other embodiments, the motion detection sensor 600, for example, may not comprise a transmitter, but rather detects infrared radiation (i.e. body heat) emitted from a nearby object. Thus, if a person that emits significant body heat approaches, the motion detection sensor 600 detects a change in signal strength and trips a threshold circuit. The deployment and types of sensors 600 that can be used in conjunction with the present invention are plentiful, and will become obvious to a person of skill in the art in view of the present invention, without further examples described herein.

In yet another exemplary embodiment, the RFID system 100 may comprise a plurality of infrared sensors and/or motion sensors 600 facing in opposite directions, e.g. a first sensor facing towards the outside/ingress side of the physical infrastructure 230 and a second sensor facing towards the inside/egress side of the physical infrastructure 230. Here, depending on the order in which the sensors 600 are triggered, the RFID reader 110 and/or the back-end system 410 may determine whether a person is entering or exiting the physical infrastructure 230 and utilize the direction in which the person is moving in determining the likelihood of a security breach. Alternatively, a directional motion sensor 600 may be used to determine the direction in which the person is approaching the entrance/exit 200. For example, assuming that a RFID tag 120 affixed to an item that has not been purchased, or otherwise, should not be leaving the physical infrastructure 230, is read by one or more of the antennas 130, the RFID reader 110 and/or the back-end system 410 may determine whether to activate the alarm, or take other appropriate action, depending on the direction of motion of the RFID tag 120 in order to minimize false alarms. Clearly, a person entering the physical infrastructure 230 with the RFID tag affixed to an item is less of a security threat.

In yet another embodiment, the RFID system 100 may comprise a temporary database to store information regarding RFID tags 120 affixed to items recently purchased by a customer for a predetermined period of time. An example time period may be a business day. Thus, in this example, any item properly sold during that day is expected to leave the store through one of the exits, and be recorded by the RFID system 100 used for electronic article surveillance in accordance with the present invention. The temporary database is coupled to the checkout points (e.g. checkout registers) of the physical infrastructure 230, as well as to the RFID system 100 of the present invention. The temporary database may be implemented to enable the RFID system 100 described in the present invention to more rapidly access information about items that have been sold properly. For example, if the RFID tag 120 associated with the sold item indeed leaves the store through one of the exits, and it is recorded by the RFID system 100, then the tag information is removed from the temporary database. Optionally, this event can also be sent to and recorded in the store's primary database. The temporary database may also be used to monitor, fix and/or improve the RFID system configuration to provide greater accuracy. For example, if the RFID tag 120 associated with the sold item is not detected by the RFID system 100 leaving the store premises during the business day, the tag information may still be removed from the temporary database by the close of the business day, since it is a reasonable expectation that all sold items leave the store before closing. However, the tag information may be recorded in the system database to assist with trouble-shooting the RFID system 100. Since all sold items are presumed to have left the store premises by the close of the business day, a missed item can be taken as an indication of the lack of accuracy of the RFID system 100 (e.g. an antenna was disabled, or not functioning properly, or simply the RFID system is not providing sufficient accuracy as a result of the placement/arrangement of at least one of the plurality of antennas).

Depending on the system design and the computing power of the RFID reader 110 and the back-end system 410, the operation of the RFID system in accordance with the present invention may be implemented by the RFID reader 110, the back-end system 410, or a combination of both system components. In operation, the plurality of antennas coupled to the RFID reader are arranged to have a spatial relationship with one another to monitor (e.g. continuously, intermittently, or triggered by an external signal, as described below) and communicate with RFID tags in the environment surrounding the antennas such that a likelihood of a security breach of the RFID tag is determined, based, at least in part, on a signal strength of a read of the RFID tag at each antenna relative to the plurality of antennas. In some embodiments, the RFID reader 110 and/or the back-end system 410 may categorize the likelihood of the security breach into one of a plurality of levels, as discussed below.

In some embodiments, the RFID reader 110 and/or the back-end system 410 may determine and store an RF profile for the visible tags in the environment (e.g. RFID tags 120 affixed to items that are merely sitting on a shelf near the entrance/exit 200) located in the surrounding environment to enhance the determination of the likelihood of a security breach of an RFID tag. The RF profile as described herein comprises data associated with each particular RFID tag detected by each antenna 130. The RF profile may include a variety of data including, but not limited to, the number and identity of RFID tags 120 visible to each of the plurality of antennas 130. Furthermore, the RF profile may also include the amplitude and possibly the phase of RF radiation received from each of the surrounding tags by each of the plurality of antennas 130. Thus, as items with affixed RFID tags 120 move around, these RF profiles are likely to be different, indicating some change in the environment or in the position of the individual RFID tag 120 as seen by each of the plurality of antennas 130. People and/or objects moving around in an environment also change the reflections, and in turn, change the RF profile to some extent. The present invention utilizes RF profiles of specific RFID tags as seen by the plurality of antennas, and changes thereto, as part of the soft decision algorithm executed to determine the likelihood of a security breach.

In these embodiments, when a change in an RF profile is detected (e.g. a new RFID tag is introduced into the environment, an RFID tag previously in the environment has been moved or is in motion, or the like), the signal strength and/or phase of the read of the RFID tag at each antenna 130 relative to the plurality of antennas is determined Once determined, the RFID reader 110 and/or back-end system 410 determines the likelihood of a security breach of the RFID tag.

In some embodiments, the relative signal strength and/or phase of the read of the RFID tag at each antenna relative to the plurality of antennas 130 is used alone to indicate the likelihood of a security breach of the RFID tag 120. For example, if the signal strength from antennas 130*a* and 130*b* are more than 10 db above the signal strength of antennas 130*c* and 130*d*, the likelihood of a security breach may be significantly higher (High Risk) than if the signal strength from antenna 130*a* is more than 10 dB above the signal strength of antennas 130*c* and 130*d*, and antenna 130*b* is only 3 dB above the signal strength of antennas 130*c* and 130*d* (Medium or Low Risk). It is important to note that specific decibels used in the description are used as a way of example only, and by no means intended to be limiting.

In other embodiments, additional information is used to determining the likelihood of a security breach of the RFID tag 120 in addition to the relative signal strength and/or phase of the read of the RFID tag at each antenna relative to the plurality of antennas 130. In these embodiments, the RFID reader 110 and/or back-end system 410 searches a database, or queries the RFID tag 120, to obtain additional information about the RFID tag 120, such as the type of item to which the RFID tag 120 is affixed, the cost of the item, whether the item has been purchased, etc. There are two standard approaches currently emerging: in a first approach, the information about the sale of the item is recorded in the RFID tag attached to the item; in a second approach, the information about the sale of the item is stored in a database, but not recorded in the RFID tag itself. For the second approach, the database may be the central database for the RFID system, or any other database available to the system, including a temporary or short-term database, that is more rapidly searchable by the RFID system, used to store on a temporary basis items recently purchased by a customer (as described in more detail below). In other embodiments in which the RFID tag is able to be queried for additional information, when the item in which the RFID tag is affixed is purchased, this information may be recorded in the RFID tag 120 at the time of purchase to indicate that the item has been properly purchased by the customer. If the system is designed such that the RFID tag 120 is later queried by the RFID reader 110 and/or back-end system 410 for additional information, the RFID tag 120 can provide purchase status of the item as well.

The RFID reader 110 and/or the back-end system 410 may execute an algorithm, based, at least in part, on the additional information obtained about the RFID tag 120. The execution of the algorithm further enhances the determination of the likelihood of a security breach. Once the algorithm is executed, the RFID reader 110 and/or the back-end system 410 may act according to the level of risk (e.g. sound an alarm, send a real-time alert, record the incident, or the like). For example, if the additional information indicates that the item to which the RFID tag 120 is affixed is allowed to leave the physical infrastructure because it was purchased by the customer, the RFID reader 110 and/or back-end system 410 may determine that the likelihood of the security breach is no or low risk. In this example, the RFID reader 110 and/or the back-end system 410 may record the RFID tag leaving the premises in a database, or may simply do nothing. In any event, a false alarm is not sounded and/or store personnel is not alerted. On the other hand, the additional information may indicate that the item to which the RFID tag 120 is affixed is not allowed to leave the physical infrastructure because it was not purchased by the customer, and the item cost is $2.00 USD. The RFID reader 110 and/or back-end system 410 may determine that the likelihood of the security breach is a medium or high risk, but because of the cost of the item, the RFID reader 110 and/or the back-end system 410 may be designed to just send a real-time alert to store personnel, or activate a video camera that captures the photo or video of the person leaving with the unpaid item, as opposed to sounding an alarm.

Optionally, if the infrared sensors and/or the motion detection sensors 600 are implemented, feedback from the sensor 600 may be implemented into the RFID system 100 at any point in the process. For example, an infrared sensor 600 can be positioned in the environment such that a possibility of a security breach is eliminated unless there is an interruption in the infrared link (i.e. the RFID tag 120 affixed to an item was carried passed a certain point). Once the interruption in the infrared link is detected, only then does the RFID reader 110 and/or back-end system 410 determine whether there is any change in the RF profile. Alternatively, the likelihood of a security breach may not be raised to a "High Risk" until an interruption in the infrared link is detected.

It is important to note that the algorithm executed to determine the likelihood of a security breach implements soft decision decoding based on the various information obtained about the RFID tag 120, and possibly the environment, to minimize false alarms. Exemplary soft decision decoding algorithms may include, but is not limited to, Maximum Likelihood Estimator, Restricted maximum likelihood, Quasi-maximum likelihood estimator, Maximum a posteriori (MAP) estimator, Method of support, M-estimator, and the like. Additionally, in determining the likelihood of a security breach, the algorithm may use weighted or un-weighted information about the RFID tag 120, and possibly the surrounding environment. For example, the cost of an item may be given more weight in determining the likelihood of the security breach than the type of item in which the RFID tag 120 is affixed. Another example is the input from the sensor 350 (i.e. whether the infrared link was interrupted) may be given more weight than the relative signal strength of the antennas 130. Furthermore, it is possible that the algorithm may determine that some changes in the RF profile do not indicate impending breach of the RFID tag 120 or significant movement of the RFID tag 120, but rather due to random fluctuation of the RFID system 100 electronics or people moving around in the environment, as those nuances are known to those skilled in the art. It should be clear to one of ordinary skill in the art that there are a large number of possibilities depending on the various possible values of the different inputs and calculations, which can be analyzed and determined by the RFID reader 110 and/or back-end system 410 to arrive at different decisions.

Moreover, the likelihood of a security breach of a particular RFID tag 120 can be classified into any number of categories indicating the level of risk depending on system design. Example categories may be, but not limited to, the following:

High Risk, Medium Risk, Low Risk

Level 1 Risk, Level 2 Risk, Level 3 Risk, Level N Risk (with n being an integer).

Red Alert, Yellow Alert, Green Alert

As a person of ordinary skill in the art can appreciate, the combination and possibilities of categories to characterize the likelihood of the security breach is infinite. For ease of simplicity, the present invention refers to High Risk, Medium Risk and Low Risk when referring to the determined likelihood of a security breach of a RFID tag 120, even though other categorization may be used. For example, using the three tier scale, the RFID reader 110 and/or the back-end system 410 may determine that there is a High Risk security breach present if the infrared link was interrupted, and a significant change in the RF profile of a particular tag 120 was detected such that the relative signal strength on the first and second antennas 130*a*, 130*b* are significantly stronger than the relative signal strength on the third and forth antennas 130*c*, 130*d*. In this case, the RFID system 100 may be designed to sound an alarm. In yet another example, the RFID reader 110 and/or the back-end system 410 may determine that there is a Medium Risk security breach present if motion is detected in the environment surrounding the antennas, however, only a minor change in the RF profile of a particular RFID tag 120 was detected such that the relative signal strength of the first and second antennas are only slightly stronger than the relative signal strength on the third and forth antennas. In this example, the RFID reader 110 and/or back-end system 410 may send a real-time alert to store personnel without sounding an alarm. Sending only the real-time alert without sounding the alarm prevents a false alarm, but places the store personnel on notice of potentially suspicious activity. In yet a final example, the RFID reader 110 and/or the back-end system 410 may consider that a Low Risk security breach is present if the infrared link was interrupted, however, no change to the RF profile was detected. This is likely the case when a person merely exits the premises. In this example, nothing is reported.

It should be noted that the RFID reader 110 and/or back-end system 410 may upgrade or downgrade the category of a RFID tag based on the subsequent movement of the RFID tag in the environment, and/or based on the weighting of the inputs. For example, if the item affixed to the RFID tag cost $50 USD, the level of risk category may be upgraded to the next level. If, however, the item affixed to the RFID tag cost $2 USD, the level of risk category may be downgraded, as the value of the item does not necessarily warrant further action. It should further be noted that if more than a single tag is breaching the security at a given time, information is gathered about all the RFID tags that are in breach, and the aggregate dollar amount of the breach is taken into consideration by the algorithm.

Further, the RFID reader 110 and/or the back-end system 410 may communicate each category differently, depending on system design. For example, if the likelihood of a security breach is determined to be a High Risk (i.e. a security breach has occurred or is imminent), the RFID reader 110 and/or back-end system 410 may be programmed to sound an audible alarm. If, for example, the likelihood of a security breach is determined to be a Medium Risk, the RFID reader 110 and/or back-end system 410 may not be programmed to sound an audible alarm, but rather send a real-time alert to a designated person or group of people (e.g. store security). If, for example, the likelihood of a security breach is determined to be a Low Risk, the RFID reader 110 and/or back-end system 410 may not be programmed to sound an audible alarm or send a real-time alert to a designated person or group of people, but rather merely record the incident in an incident log for review and/or auditing purposes. In all, or some, of these cases, a video camera may be activated to keep a visual record of the event. Alternatively, if a video surveillance camera is continually recording events, the specific frames coinciding with the breach can be marked and/or saved in a separate file for simplifying the finding and later review of these video clips.

Furthermore, as noted above, the long range detection of the RFID system 100 provides the feasibility of an advanced warning to the store personnel about a RFID tag attached to an item moving towards an area, such as the entrance/exit, which may be preempted in a more amicable fashion than sounding an alarm, or confronting customers who have already left the store. Advantageously, providing an advanced warning of an RFID tag 120 attached to an item that is approaching the entrance/exit allows time for the RFID system 100 to retrieve information from a database or query the RFID tag 120 in order to determine whether the item to which the RFID tag 120 is affixed has been paid for or not. This alleviates one of the concerns voiced by customers that relying on a database to determine whether an item has been paid for may not be fast enough, thus leading to false alarms.

In one embodiment, given the availability of the signal strength and/or phase for the read of the RFID tag by each of the plurality of antennas 130, the RFID system 100 may be capable of also tracking the motion of the RFID tag 120. In particular, knowing the phase of the read of the RFID tag as determined by each of the plurality of antennas allows the RFID system 100 to detect that an RFID tag 120 affixed to an object is approaching the entrance/exit (e.g. the gate) as opposed to merely moving in some random direction within the vicinity of the entrance/exit 200. Thus, using the phase information of the read of the RFID tag by the majority, if not all, of the antennas to indicate movement of an RFID tag approaching the entrance/exit, the RFID system 100 can provide advanced warning to store personnel that the RFID tag is approaching an area of concern.

Alternatively, the RFID reader 110 may further comprise a second set of one or more antennas positioned to detect the RFID tag approaching an area, such as the entrance/exit 200 of the physical infrastructure 230, which may be used to provide store personnel with advanced warning that a RFID tag is approaching an area of concern. In yet another alternative, the RFID system 100 may comprise at least a second RFID reader, having at least one antenna, wherein the at least one antenna for the at least second RFID reader is positioned to detect the RFID tag approaching an area, such as the entrance/exit of the physical infrastructure, which may be used to provide store personnel with advanced warning that a RFID tag is approaching an area of concern. Having the second set of antennas or the additional RFID reader(s) positioned such that reading the RFID tag can indicate or track movement of the RFID tag towards the area of concern (e.g. the entrance/exit) will provide store personnel with advanced warning of the movement of the RFID tag. This can be accomplished by recording the sequence of signals obtained from the plurality of antennas or readers. If the sequence indicates that the reader or antenna farther away from the exit detects the RFID tag first, and then the subsequent antennas or readers closer to the exit detect the RFID tag, that is an indication that the item with the RFID tag attached to it is approaching the exit. This method can also be combined with phase measurements to provide even better accuracy and/or more sensitivity regarding the motion of the RFID tag and the item associated with it. Thus, if phase determination of the read of the RFID tag is utilized or additional antennas and/or readers that are strategically positioned are implemented in the RFID system, a store may find it useful to have an advanced theft detection mechanism beyond a last minute alarm, and provide the store personnel more flexibility to respond.

Moreover, the RFID readers 110 are generally hard wired for power, however, it is possible to have battery-powered readers 110, depending on system design and system limitations. When using battery-powered RFID readers 110, motion sensors may be used to reduce the amount of time the battery-powered RFID readers 110 are active in order to preserve battery life. Furthermore, the RFID readers 110 may be configured to alert neighboring RFID readers to become active as a customer approaches. Even if battery-powered RFID readers are implemented in the RFID system, the last RFID reader before the entrance/exit may be hard wired. If the operation of the RFID system relies on a connection to a back-end system, that connection can be wired or wireless. If the RFID readers are both battery powered and wirelessly connected to the back-end system, the RFID system may be deployed without requiring any cabling, thereby simplifying the installation of the overall RFID system.

Finally, to make the RFID system of the present invention even more robust, the overall system of the physical infrastructure may be modified or enhanced to assist the RFID system in verifying whether an item has been purchased more efficiently. For example, when a person purchases an item at a checkout register, the checkout register stores information regarding the RFID tag affixed to the purchased item to a temporary database for a predetermined amount of time. As a result, the RFID reader and/or back-end system is able to quickly check the temporary database to determine whether the RFID tag in question is not a security breach. Only if the RFID tag is not found in this temporary database does the RFID reader and/or back-end system need to optionally search the store's larger database for further information and/or verification. The use of at least two databases, with at least one of the databases being a short-term database for recently purchased items, may reduce the complexity of the RFID system and improve response time since the temporary database may be smaller and more quickly searchable.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A radio frequency identification (RFID) system used to perform electronic article surveillance, the RFID system comprising:

a gate;

a first RFID reader antenna affixed to a first post of the gate;

a second RFID reader antenna affixed to a second post of the gate and wherein the first and the second RFID reader antennas are facing one another and each pointing to an inside of the gate;

a third RFID reader antenna affixed to the first post of the gate, opposite the first RFID reader antenna;

a fourth RFID antenna affixed to the second post of the gate and opposite the second RFID reader antenna, wherein the third and the fourth RFID reader antennas each pointing outward with respect to the gate, and wherein signal strength differences between the first, second, third, and fourth RFID reader antennas are used to assess a likelihood of a possible theft of an item.

2. A radio frequency identification (RFID) system used to perform electronic article surveillance in accordance with claim 1, further comprising:

a RFID tag affixed to an object; and a RFID reader coupled to the first, second, third, or fourth antennas, and in radio frequency (RF) communication with the RFID tag;

wherein the likelihood of the possible theft of the product is determined, based, at least in part, on a signal strength of a read signal of the RFID tag at the first, second, third, and fourth antennas.

3. The RFID system of claim 2, wherein the RFID reader categorizes the likelihood of the possible theft of the product into one of a plurality of levels.

4. The RFID system of claim 2, wherein the RFID reader obtains information regarding the RFID tag, to enhance the determination of the likelihood of a possible theft of the product of the RFID tag.

5. The RFID system of claim 4, wherein the information regarding the RFID tag is at least one of the following: whether an item affixed to the RFID tag has been purchased, or a cost of the item affixed to the RFID tag.

6. The RFID system of claim 4, wherein the information regarding the RFID tag is retrieved from a database or received from the RFID tag.

7. The RFID system of claim 2, wherein, based on the likelihood of the possible theft of the product as determined, the RFID reader initiates an alarm, sends an alert, records an incident, or takes no action.

8. The RFID system of claim 2, further comprising an infrared or motion sensor, positioned in close proximity to the gate, and wherein the likelihood of the possible theft of the product of the RFID tag is determined, at least in part, on information gathered from the infrared or motion sensor.

9. The RFID system of claim 2, further comprising:

a network; and a back-end system, coupled to the RFID reader, via the network, wherein at least one of the RFID reader or the back-end system determines the likelihood of a possible theft of the product of the RFID tag.

10. The RFID system of claim 2, wherein the RFID reader is configured to provide a warning that the RFID tag is approaching an area that may increase the likelihood of a possible theft of the product of the RFID tag.

11. The RFID system of claim 2, further comprising a second RFID reader, having a at least one antenna, wherein the at least one antenna for the second RFID reader is positioned and configured to provide a warning that the RFID tag is approaching an area.

12. A radio frequency identification (RFID) system used to perform electronic article surveillance, the method comprising:

a plurality of antennas in an environment to have a spatial relationship with one another such that the plurality of antennas comprise:

a first RFID reader antenna;

a second RFID reader antenna wherein the first and the second RFID reader antennas are each pointing to an inside of a gate;

a third RFID reader antenna, pointing in a direction opposite the first RFID reader antenna;

a fourth RFID antenna and pointing in a direction opposite the second RFID reader antenna, wherein the third and the fourth RFID reader antennas each pointing outward with respect to the gate; and an RFID reader determining a likelihood of a possible theft of a product affixed to an RFID tag, based, at least in part, on a signal strength of a signal read of the RFID tag determined at each antenna.

13. The system of claim 12, the RFID reader categorizing the likelihood of the possible theft of the product into one of a plurality of levels.

14. The system of claim 12, the RFID reader providing a warning that the RFID tag is approaching an area.

15. The system of claim 12, the RFID reader, based on the likelihood of the possible theft of the product as determined, initiating an alarm, sending an alert, recording an incident, or taking no action.

* * * * *